US009073334B2

(12) United States Patent
Hagiwara et al.

(10) Patent No.: US 9,073,334 B2
(45) Date of Patent: Jul. 7, 2015

(54) LIQUID EJECTING HEAD MODULE AND LIQUID EJECTING APPARATUS

(71) Applicant: Seiko Epson Corporation, Tokyo (JP)

(72) Inventors: Hiroyuki Hagiwara, Matsumoto (JP); Hiroshige Owaki, Okaya (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,476

(22) Filed: Mar. 21, 2014

(65) Prior Publication Data

US 2014/0292933 A1 Oct. 2, 2014

(30) Foreign Application Priority Data

Mar. 27, 2013 (JP) ..... 2013-065813

(51) Int. Cl.
*B41J 2/175* (2006.01)
*B41J 2/155* (2006.01)

(52) U.S. Cl.
CPC ..... *B41J 2/17563* (2013.01); *B41J 2/175* (2013.01); *B41J 2/155* (2013.01); *B41J 2202/19* (2013.01); *B41J 2202/20* (2013.01)

(58) Field of Classification Search
None
See application file for complete search history.

(56) References Cited

U.S. PATENT DOCUMENTS

2012/0127242 A1 5/2012 Koike et al.

FOREIGN PATENT DOCUMENTS

JP 2012-111044 A 6/2012

*Primary Examiner* — Justin Seo
(74) *Attorney, Agent, or Firm* — Kilpatrick Townsend & Stockton LLP

(57) ABSTRACT

A unit head has an inlet section that introduces ink from a side of a sub-tank through a porous member. The sub-tank has a pressure control section corresponding to each unit head, individually, and has an outlet section that delivers the ink from the pressure control section through a porous member. The pressure control section has a valve and a film that is displaced in response to a pressure change. The film is provided in an upper surface of the sub-tank. A frame has an inlet-side connection section to which the outlet section of the sub-tank is connected, an outlet-side connection section to which the inlet section of the unit head is connected, and a communication flow path that communicates with both connection sections. Both of the connection sections include porous members, and supply and receive the ink by a surface contact of the porous members with each other.

10 Claims, 5 Drawing Sheets

LIQUID EJECTING HEAD MODULE AND LIQUID EJECTING APPARATUS

This application claims priority to Japanese Application No. 2013-065813, filed on Mar. 27, 2013, the entirety of which is incorporated by reference herein.

BACKGROUND

1. Technical Field

The present invention relates to a liquid ejecting head module and a liquid ejecting apparatus including the liquid ejecting head module and, in particular, to a liquid ejecting head module that is configured by including a plurality of unit heads and a flow path unit supplying a liquid to each unit head in a fixing member, and a liquid ejecting apparatus.

2. Related Art

A liquid ejecting apparatus is an apparatus that includes a liquid ejecting head and ejects various types of liquids from the ejecting head. As the liquid ejecting apparatus, for example, there is an image recording apparatus such as an ink jet type printer or an ink jet type plotter. However, recently, the liquid ejecting apparatus is also applied to various types of manufacturing apparatuses by utilizing features in that a very small amount of a liquid accurately lands on a predetermined position. For example, the liquid ejecting apparatus is applied to a display manufacturing apparatus for manufacturing a color filter of a liquid crystal display or the like, an electrode forming apparatus for forming an electrode of an organic electro luminescence (EL) display, a field emission display (FED) or the like, and a chip manufacturing apparatus for manufacturing a biochip (a biochemistry element). Then, a recording head used for the image recording apparatus ejects liquid ink and a color material ejecting head used for the display manufacturing apparatus ejects solution of each color material of R (Red), G (Green), and B (Blue). Further, an electrode material ejecting head used for the electrode forming apparatus ejects a liquid electrode material and a bio-organic material ejecting head used for the chip manufacturing apparatus ejects solution of a bio-organic material.

Recently, as the printer described above, there is a printer that includes an ink jet type recording head (hereinafter, simply referred to as a recording head) that is a type of a liquid ejecting head, and has a flow path unit (also referred to as a sub-tank or a self-sealing valve) for supplying ink to the recording head (for example, see JP-A-2012-111044). The flow path unit is configured by including a pressure adjustment device that has a flow path inside thereof which receives the ink from an ink supply source such as an ink cartridge and transmits the ink to a side of the recording head, and adjusts a supplying pressure of the ink in a certain range in the middle of the flow path. The pressure adjustment device has a valve that switches supply and non-supply of the ink, and a flexible member such as a film that opens and closes the valve by being displaced in response to a pressure change in the flow path member. That is, the flexible member is provided on at least one surface of the flow path member.

Recently, a plurality of recording heads described above which are modularized by fixing the recording heads as unit heads to a metal frame (a fixing member) is also proposed. In the head module of the related art, the flow path unit having the pressure adjustment device described above is provided in each unit head. Thus, the head module tends to be large in proportion to the number of the unit heads to be mounted. Meanwhile, there is a request for downsizing of the head module. In particular, there is a need to suppress a height of the head module rises in response to the request to suppress the height of the printer.

SUMMARY

An advantage of some aspects of the invention is to provide a liquid ejecting head module capable of downsizing of a head module and, in particular, suppressing a height thereof, and a liquid ejecting apparatus including the liquid ejecting head module.

According to an aspect of the invention, there is provided a liquid ejecting head module including: a unit head that introduces a liquid into a liquid flow path formed inside thereof and ejects the liquid from nozzles which are open on a nozzle surface; a fixing member to which a plurality of unit heads are fixed to a side of a first surface; and a common flow path unit that has a common flow path, which distributes the liquid to each unit head fixed to the fixing member by receiving the liquid from a liquid supply source, along an arrangement direction of the unit heads in series, and is attached to a mounting surface of the fixing member that is positioned on the side opposite the nozzle surface of the unit head that is fixed. The unit head has an inlet section that introduces the liquid from a side of the common flow path unit into the liquid flow path through a first porous member. The common flow path unit has a pressure control section that controls a pressure of the liquid supplied from the common flow path to the unit head corresponding to each unit head, individually, and has an outlet section that delivers the liquid from the pressure control section through a second porous member. The pressure control section has a valve that switches supply or non-supply of the liquid, and a flexible member that opens and closes the valve by being displaced in response to a pressure change inside the pressure control section. The flexible member is provided on a surface on the side opposite a side of the fixing member in the common flow path unit. The fixing member has an inlet-side connection section to which the outlet section of the common flow path unit is connected, an outlet-side connection section to which the inlet section of the unit head is connected, and a communication flow path that communicates with the inlet-side connection section and the outlet-side connection section. The inlet-side connection section includes a third porous member where the second porous member of the outlet section abuts. The outlet-side connection section includes a fourth porous member where the first porous member of the inlet section abuts. Supplying and receiving of the liquid are performed by surface contact between the second porous member and the third porous member and by surface contact between the first porous member and the fourth porous member.

In this case, the common flow path unit including the common flow path that supplies the liquid from the liquid supply source to the unit head and the pressure control section corresponding to each unit head is a member that is common to each unit head, and the flexible member of the pressure control section is provided in a surface on the side opposite the side of the fixing member in the common flow path unit. Therefore, it is possible to suppress the height of the whole head module compared to in a configuration that includes the flow path unit having the pressure control section in each unit head, individually. In particular, it is possible to ensure an area, which is required for the operation of the flexible member, in the horizontal direction that is substantially parallel to the nozzle surface by providing the flexible member that requires a certain area to ensure responsiveness to the pressure change in the pressure control section on the surface on the side opposite the side of the fixing member in the common flow path unit. Therefore, it is possible to reduce a thickness (a dimension in a laminating direction with the fixing member) of the flow path unit to be as low as possible without being restricted to the area of the flexible member.

Further, since supplying and receiving of the liquid between the common flow path unit and the fixing member, and supplying and receiving of the liquid between the fixing member and the unit head are performed by surface contact between porous members, it is possible to save space compared to a configuration in which supplying and receiving of the liquid is performed by using a hollow needle-shaped member.

Therefore, it is possible to reduce the height of the whole head module by combining those configurations.

In the liquid ejecting head module, it is preferable that a configuration be employed in which a filter that filters the liquid inside the flow path is provided in the middle of the flow path connecting between the liquid supply source and the common flow path unit.

In this case, an installation space of the filter is not required in the common flow path unit compared to a configuration in which the filter is provided in the common flow path unit, and it is possible to downsize the common flow path unit accordingly. As a result, this contributes to the downsizing of the whole head module. Further, since there is no need to remove the common flow path unit from the fixing member when replacing the filter, replacement operation is improved.

Further, it is preferable that a configuration be employed in which the fixing member has a first fixing member that has a mounting surface to which the common flow path unit is attached and a second fixing member that protrudes from a surface on the side opposite the mounting surface of the first fixing member, and has a fixing surface that is vertical to the surface, and the unit heads are respectively fixed to the fixing surfaces on both sides of the second fixing member so as to alternate with each other in the arrangement direction of the unit heads.

In this case, since the fixing member is formed by combining the first fixing member and the second fixing member so as to intersect each other, rigidity of the whole fixing member improves compared to a configuration having only one member. Therefore, it is possible to ensure positional accuracy of the unit heads fixed to the fixing member and, in particular, positional accuracy of nozzles.

In the liquid ejecting head module, it is preferable that a configuration be employed in which the unit head has the inlet section on the surface on the side opposite the nozzle surface and the outlet-side connection section is disposed in a position facing the inlet section of the surface of the fixing member facing each unit head.

In this case, since the inlet section is provided on the surface on the side opposite the nozzle surface of the unit head and is not provided in the side surface of the unit head, it is possible to suppress the dimension in the width direction of the head module, and, specifically, in the direction intersecting the arrangement direction of the unit heads, accordingly, and it is possible to suppress the width of the whole head module.

Further, it is also possible to employ a configuration in which the outlet-side connection section is provided on the side of the fixing surface of the second fixing member and the unit head has the inlet section in a position facing the outlet-side connection section on the surface of a mounting side with respect to the fixing surface.

In this case, since the inlet section is not positioned on the surface on the side opposite the nozzle surface of the unit head, it is possible to suppress the dimension in the height direction and it is possible to reduce the height of the whole head module, accordingly.

According to another aspect of the invention, there is provided a liquid ejecting apparatus including the liquid ejecting head module according to the above configurations.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the accompanying drawings. Moreover, in the embodiments described below, various limitations are considered as preferred embodiments of the invention, but the scope of the invention is not limited to the embodiments in the following description unless an effect of limiting the invention is stated in particular. Further, in the following description, as a liquid ejecting apparatus of the invention, an ink jet type printer (hereinafter, referred to as a printer) is exemplified that is equipped with a head module 2 that is formed by fixing a plurality of ink jet type recording heads (hereinafter, referred to as unit heads), which is a type of a liquid ejecting head.

Figure 1A:
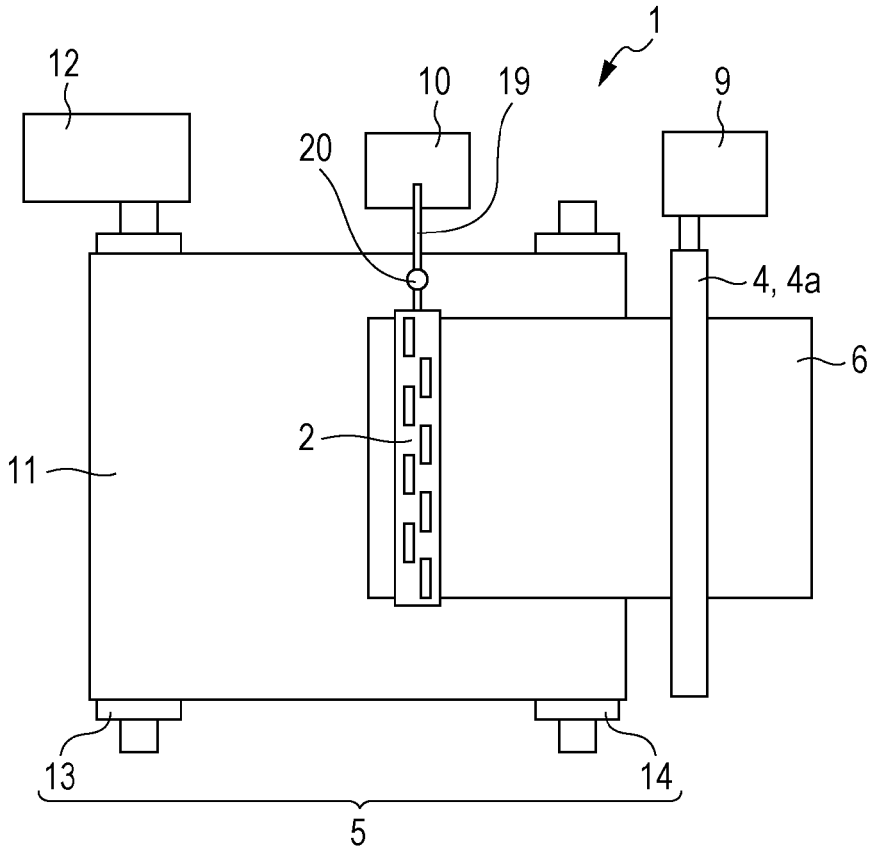
FIGS. 1A and 1B are schematic views describing an internal configuration of a printer.
Figure 1B:
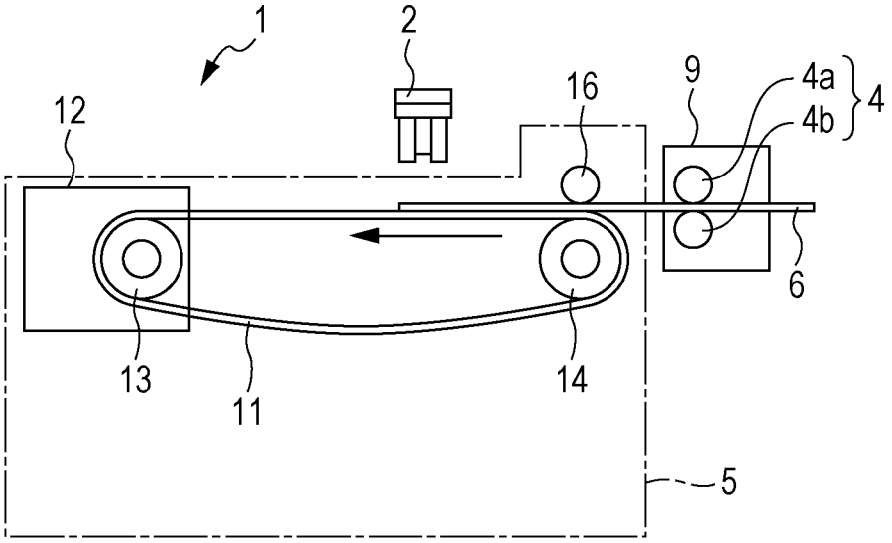

FIGS. 1A and 1B are schematic views describing an internal configuration of a printer 1, FIG. 1A is a plan view and FIG. 1B is a side view. The printer 1 includes the head module 2 that is long along a width direction (a direction substantially orthogonal to a transportation direction of a recording paper) of a recording paper 6 (a type of a recording medium or a landing target) such as a rolled paper, a paper feeding roller 4 that supplies the recording paper 6 to a transportation belt 11, a paper feeding motor 9 that drives the paper feeding roller 4, a transportation device 5 that transports the recording paper 6 by the transportation belt 11, and an ink cartridge 10 (a type of a liquid supply source) that stores ink. In the embodiment, the printer 1 is a so-called line head type ink jet recording apparatus in which only the transportation of the recording paper 6 is performed and scanning of the head module 2 is not performed in the width direction of the recording paper 6 when the recording is operated.

The paper feeding roller 4 is configured of a pair of upper and lower rollers 4*a* and 4*b* that are disposed on an upstream side of the transportation device 5 and are capable of synchronously rotating in the opposite directions to each other in a state of clamping the recording paper 6 that is supplied from a paper feeding section (not illustrated). The paper feeding roller 4 is configured so as to be driven by power from the paper feeding motor 9 and supplies the recording paper 6 to a side of the transportation device 5. The transportation device 5 is configured of a transportation motor 12 that is a driving source of the transportation belt 11, a driving roller 13 to which power is transmitted from the transportation motor 12, a driven roller 14 that is disposed on the upstream side from the driving roller 13, an endless transportation belt 11 that is stretched tightly between the driving roller 13 and the driven roller 14, and a pressing roller 16 that presses the recording paper 6 to a side of the transportation belt 11. The pressing roller 16 is disposed immediately above the driven roller 14 across the transportation belt 11 and abuts the transportation belt 11.

Figure 2:
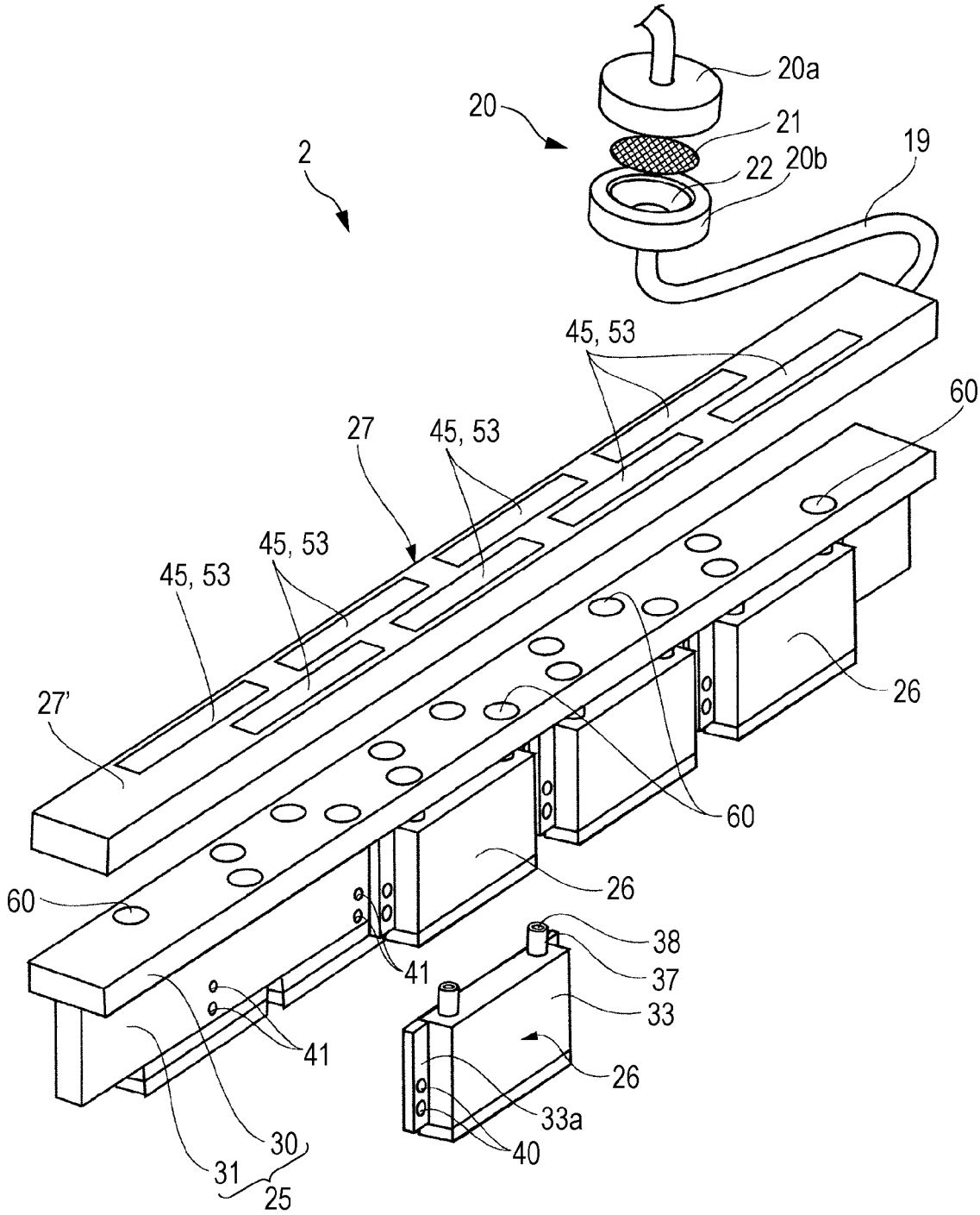
FIG. 2 is an exploded perspective view of a head module.

The ink cartridge 10 and a sub-tank 27 (a type of a common flow path, see FIG. 2) of the head module 2 are connected to each other, for example, by a supply tube 19 that is made of a member having flexibility such as silicone resin. The ink stored in the ink cartridge 10 is pumped to a side of the head module 2 through the supply tube 19 by a pump (not illustrated). In the embodiment, a filter unit 20 is provided in the middle of the supply tube 19. As illustrated in FIG. 2, the filter unit 20 is a member in which a filter accommodating section 22 that accommodates a filter 21 inside a pair of separable filter cases 20*a* and 20*b* is formed. The filter 21 is a member for filtering the ink flowing into the supply tube 19 and prevents foreign matters and air bubbles from flowing into the side of the head module 2. For example, as the filter 21, a filter in which a plurality of through holes are open in a thin metal plate or a filter in which metal is finely woven into a mesh shape may be used. The filter accommodating section 22 is configured of a first accommodating section (not illustrated) that is formed inside the upper case 20*a* and is widened in diameter from an upstream side (the side of the ink cartridge 10) to a disposition side (a downstream opening side) of the filter 21, and a second accommodating section that is formed inside the lower case 20*b* and is reduced in diameter from the disposition side (an upstream opening side) of the filter 21 to a downstream side (the side of the head module 2). The filter 21 is disposed in a clamped form between the first accommodating section and the second accommodating section.

The filter 21 is capable of being removed and replaced if necessary, such as during maintenance. The filter is not provided in the sub-tank 27 itself according to the invention and the filter 21 is provided inside the filter unit 20 with a so-called external type on the outside of the sub-tank 27 while the filter is provided in the flow path member such as the sub-tank in the head module of the related art. Since it is not necessary to remove the sub-tank 27 from a frame 25 (a type of a fixing member) when replacing the filter 21 by employing such a configuration, replacement workability improves and it is possible to contribute to downsizing of the sub-tank 27 as long as a installation space of the filter 21 does not exist in the flow path member. Therefore, this contributes to the downsizing of the whole head module 2. Moreover, in the embodiment, for the sake of convenience, a configuration corresponding to one type of the ink is exemplified, but the supply tube 19 and the filter unit 20 (the filter 21) are provided in each type of the ink in a configuration in which a plurality (a plurality of colors) of types of the inks are handled. In the configuration, a main body of the filter unit 20 is common to various types of the inks and the flow path and the filter 21 inside thereof may be provided individually for each type of the ink.

Figure 3:
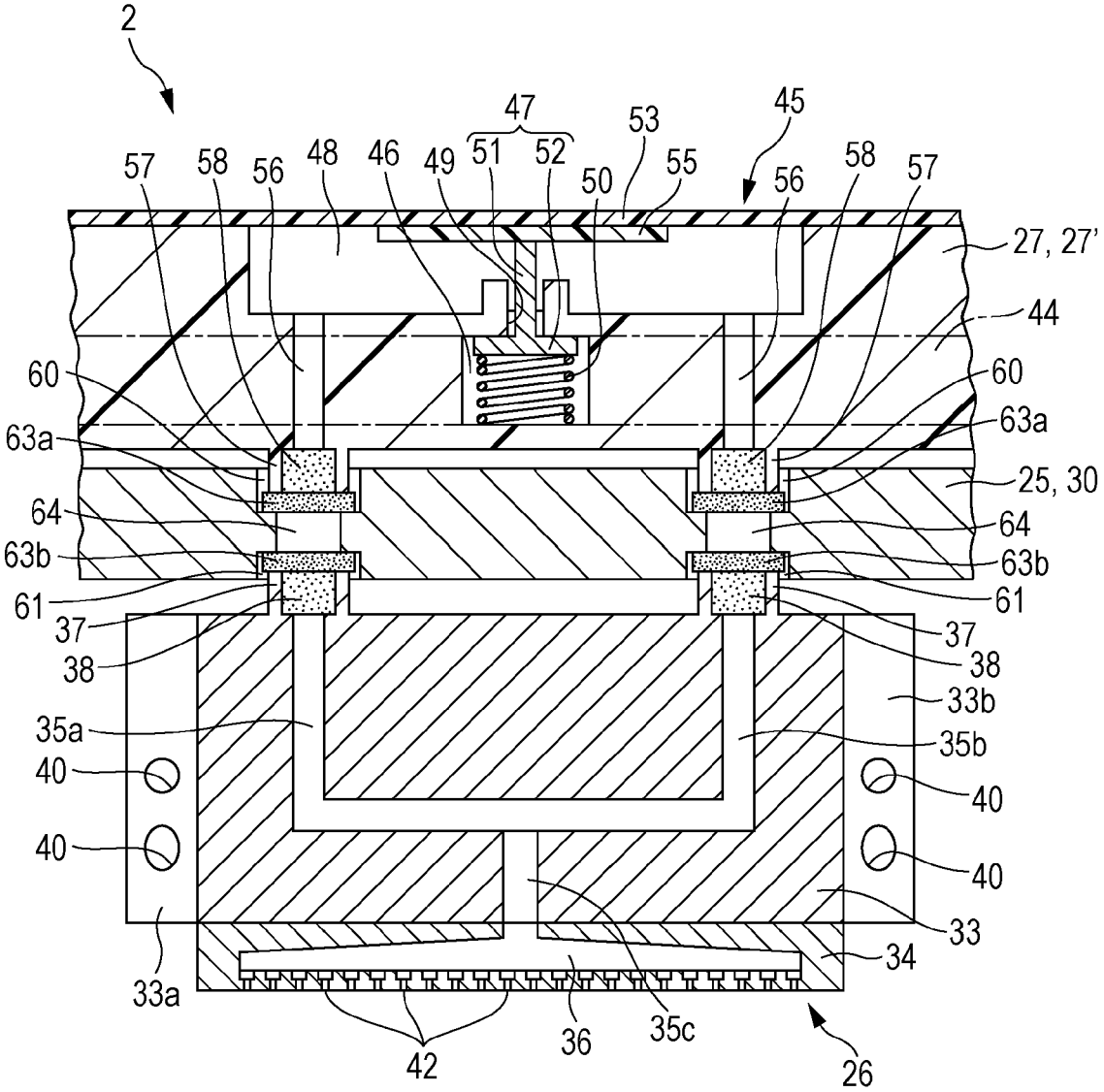
FIG. 3 is a cross-sectional view of a main portion of the head module in a longitudinal direction in a closed valve state.
Figure 4:
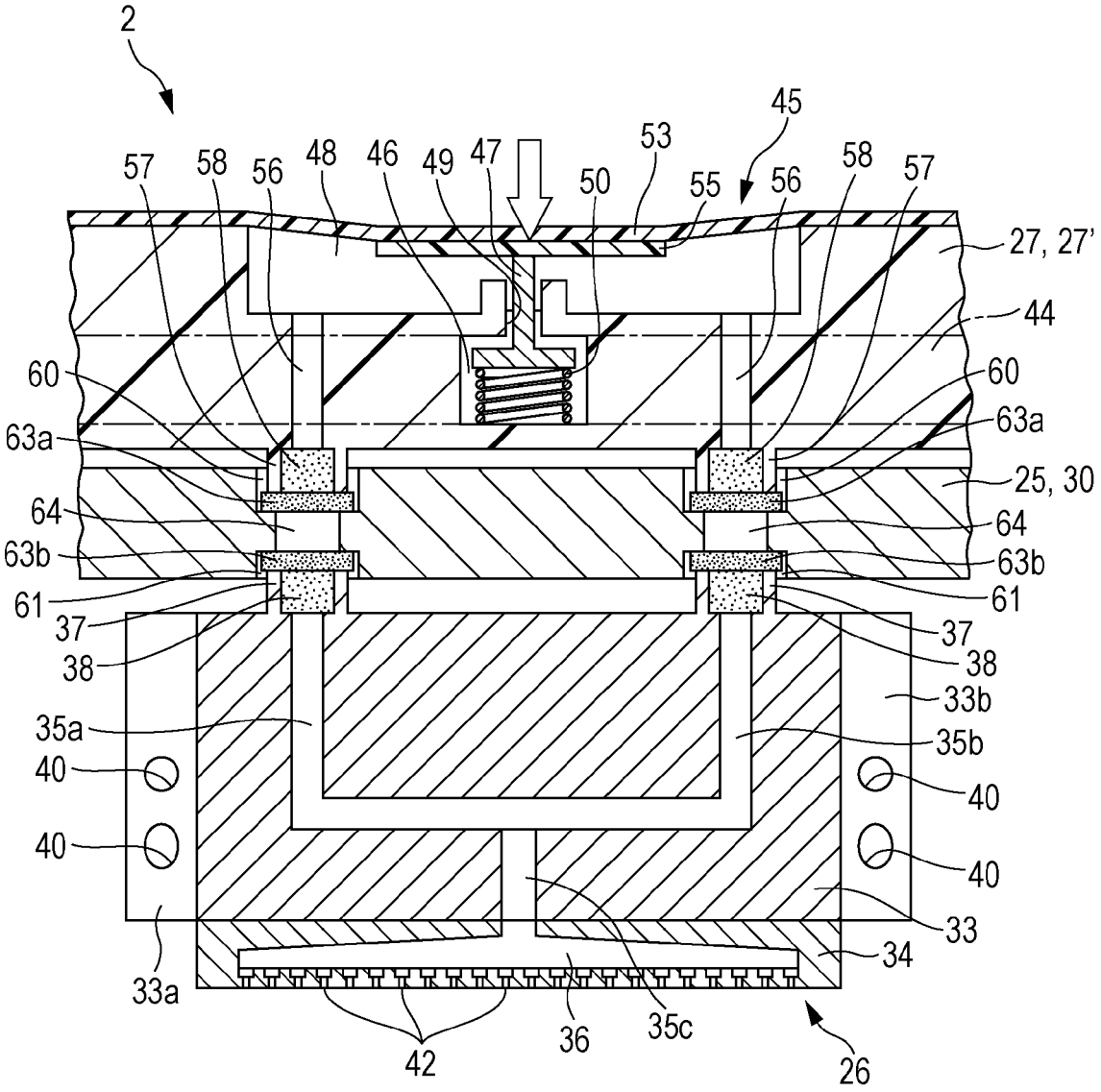
FIG. 4 is a cross-sectional view of a main portion of the head module in a longitudinal direction in an open valve state.
Figure 5:
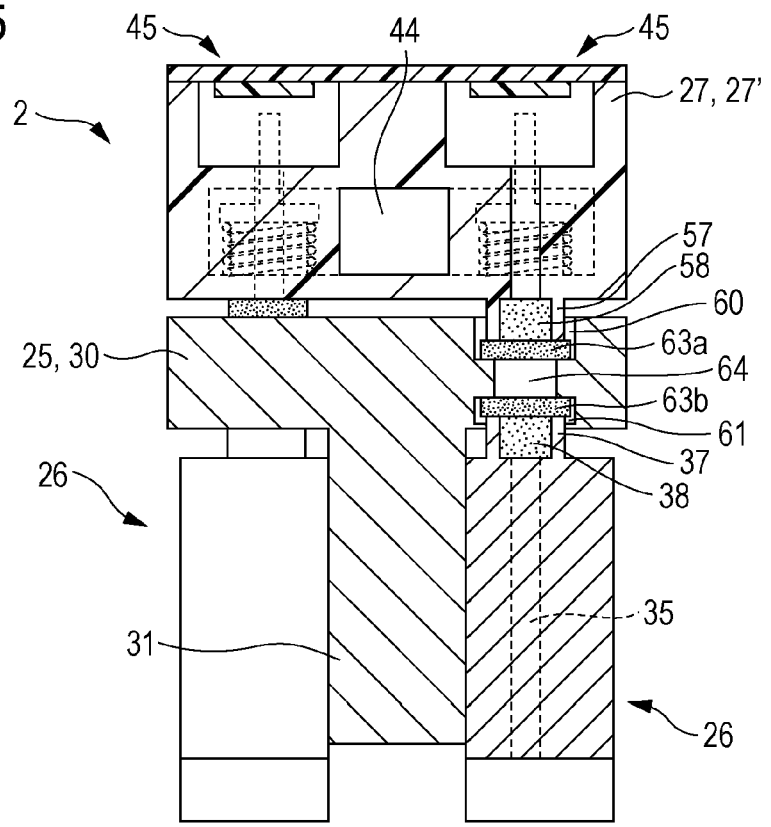
FIG. 5 is a cross-sectional view of a main portion of the head module in a short direction.

FIG. 2 is an exploded perspective view describing a configuration of the head module 2 in the embodiment. Further, FIG. 3 is a cross-sectional view of a main portion of the head module 2 in a longitudinal direction (an arrangement direction of unit heads) in a closed valve state. FIG. 4 is a cross-sectional view of a main portion of the head module 2 in the longitudinal direction in the closed valve state. Further, FIG. 5 is a cross-sectional view of the head module 2 in a short direction. Moreover, in FIGS. 3 and 4, a configuration corresponding to one unit head is illustrated.

For example, in the embodiment, the head module 2 is configured by attaching a plurality of unit heads 26 and the sub-tank 27 which is common to each unit head 26 to the frame 25 made of metal such as stainless steel. The frame 25 is formed by combining a base frame 30 (a type of a first fixing member) which is long in a direction intersecting (orthogonal) with the transportation direction of the recording paper 6, and a fixing frame 31 (a type of a second fixing member) that is extruded downward (a side of the recording paper 6 or an ejecting side of the ink when the recording is operated) from a lower surface (a surface on the side opposite an upper surface that is a mounting surface to which the sub-tank 27 is attached) of the base frame 30 in a T-shape in a side view. Therefore, front and back surfaces of the fixing frame 31 are perpendicular to upper and lower surfaces of the base frame 30. The front and back surfaces of the fixing frame 31 are fixing surfaces to which the unit heads 26 are fixed. Then, the head module 2 is disposed in the apparatus of the printer 1 in a posture in which one fixing surface faces the upstream side of the recording paper 6 in the transportation direction and the other fixing surface faces the downstream side of the recording paper 6 in the transportation direction. As described above, since the frame 25 is formed by combining the base frame 30 and the fixing frame 31 so as to intersect each other, rigidity of the frame 25 improves. Therefore, it is possible to ensure positional accuracy of the unit heads 26 that are fixed to the frame 25, in particular, positional accuracy of nozzles 42.

The plurality of unit heads 26 are respectively attached to the fixing surface of the fixing frame 31 along the longitudinal direction of the frame 25 in a posture in which a nozzle surface (a nozzle plate) where the nozzles 42 are formed faces the side of the recording medium when the recording is operated. In the embodiment, eight unit heads 26 in total are fixed by screwing in a manner such that four unit heads 26 are fixed to each of the front and back fixing surfaces of the fixing frame 31. The unit heads 26 of one fixing surface and the unit heads 26 of the other fixing surface are disposed to be alternate with each other in the longitudinal direction of the frame.

The unit head 26 is configured of a head case 33 and a head chip 34. The head case 33 is a hollow box-shaped member in which a case flow path 35 is formed. Flange sections 33*a* and 33*b* of which a thickness is thinner than that of the head case 33 are respectively provided on both sides of the head case 33. Mounting holes 40 are open in the flange sections 33*a* and 33*b*. A fastening member such as a screw is inserted into the mounting holes 40 corresponding to fastening holes 41 which are open in head fixing portions of the fixing frame 31. The case flow path 35 formed inside the head case 33 is a flow path that introduces the ink delivered from the side of the sub-tank 27 to the side of the head chip 34. In the embodiment, the case flow path 35 is configured of a total of two inlet-side flow paths 35*a* and 35*b* in a manner such that each path is provided on each side in the arrangement direction of the nozzle column (the longitudinal direction of the frame), and an outlet-side flow path 35*c* which communicates with each of the inlet-side flow paths 35*a* and 35*b*, and of which a downstream end communicates with a reservoir 36 of the head chip 34. In the embodiment, upstream ends of the inlet-side flow paths 35*a* and 35*b* are open to an upper side (a surface on the side opposite the nozzle surface in which the nozzles 42 are formed) of the head case 33. Each cylindrical inlet section 37 surrounding an opening protrudes in an edge portion of the opening. A porous member 38 (equivalent to a first porous member) which is formed of a member having a plurality of gaps, for example, a foam material such as sponge, fiber bundles, a filter or the like, is accommodated inside the inlet section 37.

The head chip 34 is configured by laminating the nozzle plate in which a plurality of nozzles 42 are open; a flow path forming member in which individual flow paths including pressure chambers each communicating with the nozzles 42, the reservoir 36 that is a hollow liquid chamber section common to each individual flow path, or the like is formed; a pressure generating unit (an actuator) such as a piezoelectric element that generates a pressure variation in the ink inside the individual flow paths; and the like (none of which are illustrated). The individual flow paths or the reservoir 36 inside the head chip 34, and the case flow path 35 inside the head case 33 are equivalent to the liquid flow paths of the invention. The ink delivered from the side of the sub-tank 27 through a communication flow path of the frame 25 flows into the case flow path 35 through the porous member 38 inside the inlet section 37 described above and is distributed from the reservoir 36 to each individual flow path after the ink is introduced from the case flow path 35 into the reservoir 36. Then, the pressure variation is generated inside the individual flow paths by driving the pressure generating unit and ink droplets are ejected from the nozzles 42 by the pressure variation. The nozzles 42 configure a nozzle column (a nozzle group) by being arranged in a pitch corresponding to a dot formation density in a width direction (a direction intersecting the transportation direction) of the recording paper 6 to be printed. Then, the whole length of each nozzle column of each unit head 26 which is fixed to the frame 25 is set to a length corresponding to the maximum width of the recording paper 6.

In the embodiment, the sub-tank 27 is a member in which a common flow path 44 that is common to each unit head 26 and a plurality of pressure control sections 45 that are provided in each unit head 26 are formed inside a rectangular parallelepiped body 27' that is molded by a synthetic resin such as polypropylene. The common flow path 44 is formed in series from one end (a connecting side to the supply tube 19) of the body 27' in the longitudinal direction to the pressure control section 45 corresponding to the unit head 26 that is provided on the other end side. In FIGS. 3 and 4, the common flow path 44 extends along a lateral direction of a depth side of the pressure control section 45. Then, each pressure control section 45 communicates with the common flow path 44, individually. Moreover, in a configuration in which several types (a plurality of colors) of inks are handled, each flow path is independently provided for each type of the ink.

The pressure control section 45 is a device for maintaining a supply pressure of the ink that is supplied in the unit head 26 within a predetermined range. In the embodiment, since each unit head 26 fixed to the fixing frame 31 is disposed to be alternate with each other in the longitudinal direction of the frame across the fixing frame 31, each pressure control section 45 in the body 27' is also arranged in two columns in the width direction of the body 27' to be alternate with each other corresponding to the unit heads 26. Each pressure control section 45 includes an inlet chamber 46, a valve 47, a pressure adjustment chamber 48 or the like. The inlet chamber 46 is a hollow section that is provided in a position close to a lower surface of the body 27' and communicates with the common flow path 44. Further, the inlet chamber 46 communicates with the pressure adjustment chamber 48 through a communication port 49. The valve 47 and a biasing member 50 that biases the valve 47 to a side of the pressure adjustment chamber 48 are accommodated inside the inlet chamber 46.

The valve 47 is configured to be capable of converting to the open valve state (state illustrated in FIG. 4) that permits the introduction of the ink from the side of the inlet chamber 46 to the pressure adjustment chamber 48 through the communication port 49 and the closed valve state (state illustrated in FIG. 3) that blocks the introduction of the ink to the pressure adjustment chamber 48, and is biased to a side of a closed valve position by the biasing member 50 formed of a coil spring. The valve 47 is configured of a cylindrical shaft section 51 and a substantially disk-shaped plate section 52 provided on a side of a base end of the shaft section 51. An outer diameter of the shaft section 51 is formed so as to be smaller than an inner diameter of the communication port 49. Then, a leading end section of the shaft section 51 is inserted into the pressure adjustment chamber 48 through the communication port 49. Then, the ink is introduced from the side of the inlet chamber 46 into the pressure adjustment chamber 48 through a gap between an outer peripheral surface of the shaft section 51 and an inner peripheral surface of the communication port 49. In contrast, an outer diameter of the disk-shaped plate section 52 is set to be greater than an inner diameter of the communication port 49. Thus, when the plate section 52 comes into close contact with an opening edge section of the communication port 49 on the side of the inlet chamber 46 in the closed valve state, the configuration is such that entry of the ink is prevented by blocking the communication port 49.

The biasing member 50 biases the valve 47 to the side of the pressure adjustment chamber 48 by abutting the plate section 52 of the valve 47 and maintains the closed valve state until the pressure of the pressure adjustment chamber 48 is reduced to a predetermined pressure. That is, the valve 47 that is biased on the side of a ceiling surface of the inlet chamber 46 by the biasing member 50 is maintained in the closed valve position in which the plate section 52 comes into close contact with the opening edge section of the communication port 49 unless the valve 47 is subjected to stress against an elastic force of the biasing member 50. Then, in the closed valve position, the valve 47 blocks the introduction of the ink from the side of the inlet chamber 46 to the side of the pressure adjustment chamber 48.

The pressure adjustment chamber 48 is a concave section that is open to the upper surface (the side opposite the side of the base frame 30) of the body 27'. In a state where the opening of the side of the upper surface of the pressure adjustment chamber 48 is blocked, a film 53 (equivalent to a flexible member) having flexibility is adhered to the upper surface of the body 27'. In order to be displaceable in response to the pressure change inside the pressure adjustment chamber 48, the film 53 is required to be a material that is soft and is low in moisture permeability in nitrogen or in oxygen permeability. Thus, in the embodiment, the film 53 is formed of a three-layer structure in which a polypropylene film layer, a barrier layer made of silica ($SiO_2$) and a reinforcing layer made of polyethylene terephthalate are superimposed and laminated in order from the inside (on the side of the pressure adjustment chamber 48 or the inlet chamber 46) thereof.

A pressure receiving plate 55 formed by a material that is hard compared to the film 53 is attached to a substantially central section of the film 53. In the embodiment, the pressure receiving plate 55 is formed in a plate shape having an area smaller than that of the opening of the pressure adjustment chamber 48 by a plastic material such as polyethylene and polypropylene. The pressure receiving plate 55 is attached to the film 53 in advance by heat welding or the like at a stage before the film 53 is attached to the body 27'. If the film 53 is displaced in response to the pressure change inside the pressure adjustment chamber 48, the pressure receiving plate 55 is displaced along with the film 53. That is, if the film 53 is displaced to the side of the valve 47 in response to the decrease in the pressure inside the pressure adjustment chamber 48, the pressure receiving plate 55 is also displaced to the side of the valve 47, thereby pressing the valve 47 to the open side of the valve (the side of the inlet chamber 46). Moreover, there is also a configuration in which the pressure receiving plate 55 is not provided with respect to the film 53. That is, the film 53 directly presses the valve 47. In either configuration, the film 53 opens and closes the valve 47 directly or indirectly.

Outlet paths 56 are respectively provided on both sides across the inlet chamber 46 in the extending direction of the common flow path 44. An upper end of the outlet path 56 communicates with the pressure adjustment chamber 48 and an lower end of the outlet path 56 communicates with a cylindrical outlet section 57 where a lower end of the outlet path 56 protrudes on a side of a lower surface of the body 27'. A porous member 58 (equivalent to a second porous member) is accommodated inside the outlet section 57. Then, the ink that flows down the outlet path 56 from the side of the pressure adjustment chamber 48 is absorbed and held in the porous member 58 of the outlet section 57.

The base frame 30 of the frame 25 has connection sections 60 and 61 which are hollow in the thickness direction of the base frame 30 corresponding to each outlet section 57 of the sub-tank 27 and each inlet section 37 of each unit head 26. That is, the inlet-side connection sections 60 are respectively formed in positions corresponding to the outlet sections 57 of each pressure control section 45 in the sub-tank 27 on a side (equivalent to the mount section that is positioned on the side opposite the nozzle surface of the unit head 26 which is fixed) of the upper surface of the base frame 30 that is the mounting surface of the sub-tank 27. Further, each outlet-side connection section 61 is formed in a position corresponding to the inlet sections 37 of each unit head 26 on the lower side of the base frame 30 that is the disposition side of each unit head 26. That is, the outlet-side connection section 61 is disposed in the position facing the inlet section 37 of the surface facing each unit head 26 in the frame 25. The inlet-side connection section 60 is a concave section that is set to be a size capable of fitting the outlet section 57 of the sub-tank 27 in a state where the sub-tank 27 is mounted on the base frame 30. Similarly, the outlet-side connection section 61 is a concave section that is set to be a size capable of fitting the inlet section 37 of the unit head 26 in a state where the unit head 26 is fixed to the fixing frame 31. A porous member 63*a* (equivalent to a third porous member) is disposed inside the inlet-side connection section 60. Similarly, a porous member 63*b* (equivalent to a fourth porous member) is disposed inside the outlet-side connection section 61. Then, the inlet-side connection section 60 and the outlet-side connection section 61 of which the positions overlap in a plan view communicate with each other through a communication flow path 64.

If the outlet section 57 fits the inlet-side connection section 60 when the sub-tank 27 is attached to the base frame 30, the porous member 58 inside the outlet section 57 and the porous member 63*a* inside the inlet-side connection section 60 come into elastic contact with each other. In this state, the ink that is soaked and held in the porous member 58 moves to the side of the porous member 63*a* and flows down the communication flow path 64 and is absorbed and held in the porous member 63*b* inside the outlet-side connection section 61. Similarly, if the unit head 26 is fixed to the fixing frame 31 and the inlet section 37 of the unit head 26 fits the outlet-side connection section 61, the porous member 63*b* inside the outlet-side connection section 61 and the porous member 38 inside the inlet section 37 come into elastic contact with each other. In this state, the ink that is held in the porous member 63*b* moves to the side of the porous member 38 and is introduced into the unit head 26. The ink introduced into the unit head 26 flows down the case flow path 35 and is introduced into the reservoir 36, and then is distributed from the reservoir 36 to each individual flow path. Moreover, in the embodiment, for the connection portions of the flow paths, a configuration is exemplified in which the connection sections (the connection sections 60 and 61) on the side of the base frame 30 are concave shapes and the connection sections (37 and 57) of the sub-tank 27 and the unit head 26 are convex shapes, but the invention is not limited to the embodiment. For example, a relationship of convexo-concave may be reversed and the connection sections may be configured to be connected to each other with each convex.

In the pressure control section 45 described above, if the introduction of ink into the pressure adjustment chamber 48 is blocked by the valve 47, an internal pressure of the pressure adjustment chamber 48 is gradually reduced by consumption of the ink by the unit head 26. If the inside of the pressure adjustment chamber 48 is reduced to a predetermined pressure (the minimum pressure in which the unit head 26 ejects the ink without fear of disturbing the ejection of the ink), the film 53 is bent to the inside of the pressure adjustment chamber 48 and presses the leading end section of the shaft section 51 of the valve 47 that is in the closed valve position through the pressure receiving plate 55 and then moves the valve 47 to an opening direction (on the side of the inlet chamber 46) while resisting against a biasing force of the biasing member 50 (FIG. 4). Therefore, the plate section 52 of the valve 47 is separated from the opening edge section of the communication port 49 and the valve 47 is displaced to the position (the closed valve position) in which a close contact state is released. In the open valve position, the ink flows into the pressure adjustment chamber 48 from the side of the inlet chamber 46 through the communication port 49. If the ink is introduced into the pressure adjustment chamber 48, the internal pressure of the pressure adjustment chamber 48 is increased from the minimum pressure described above. If the internal pressure of the pressure adjustment chamber 48 is increased, the film 53 is displaced to the upper side (one side) of the pressure adjustment chamber 48. Therefore, the valve 47 moves to the side of the pressure adjustment chamber 48 by an elastic force of the biasing member 50 and is displaced to the closed valve position again, and then blocks the flow of the ink into the pressure adjustment chamber 48. The ink flowing into the pressure adjustment chamber 48 is supplied from the outlet section 57 to the side of the unit head 26 through the communication flow path 64 of the frame 25.

As described above, in the head module 2 according to the invention, the common flow path 44 that is common to the plurality of unit heads 26 fixed to the frame 25 is formed, the sub-tank 27 including the pressure control section 45 in each unit head 26 is provided, individually, and the flexible member that opens and closes the valve of the pressure control section 45 is provided on the side of the upper surface (the side opposite the connection side to the base frame 30) of the sub-tank body 27'. Therefore, it is possible to save space of an installation region of the sub-tank 27, in particular, to suppress the dimension in the height direction thereof compared to in the configuration of the related art in which the sub-tank is provided in each unit head, individually. In particular, it is possible to ensure an area which is required for the operation of the film 53 in a plane direction (a horizontal direction substantially parallel to the nozzle surface, in particular, the arrangement direction of the heads) by providing the film 53 that requires a certain area to ensure responsiveness to the pressure change inside the pressure control section 45 on the upper surface on the side opposite the side of the frame 25 in the sub-tank 27. Therefore, it is possible to suppress the thickness (the height) of the sub-tank 27 to be as low as possible without being restricted to the area of the film 53. Further, since the configuration is provided in which supplying and receiving of the ink between the sub-tank 27 and the frame 25, and supplying and receiving of the ink between the frame 25 and the unit head 26 are performed by surface contact between the porous members, it is possible to save space more than in a configuration in which supplying and receiving of the ink is performed by using a hollow needle-shaped member.

Therefore, it is possible to reduce the overall height of the head module 2 by combination of those configurations.

Further, in the embodiment, since the inlet section 37 of the unit head 26 is provided on the upper surface of the unit head and is not positioned on the side surface thereof, it is possible to suppress the dimension in the horizontal direction, in particular, in the direction intersecting the arrangement direction of the unit heads, accordingly. That is, in the embodiment, as illustrated in FIG. 5, since the unit head 26 can be fixed by coming into close contact with the fixing frame 31, it is possible to suppress the dimension in the short direction (the width direction) of the frame.

Figure 6:
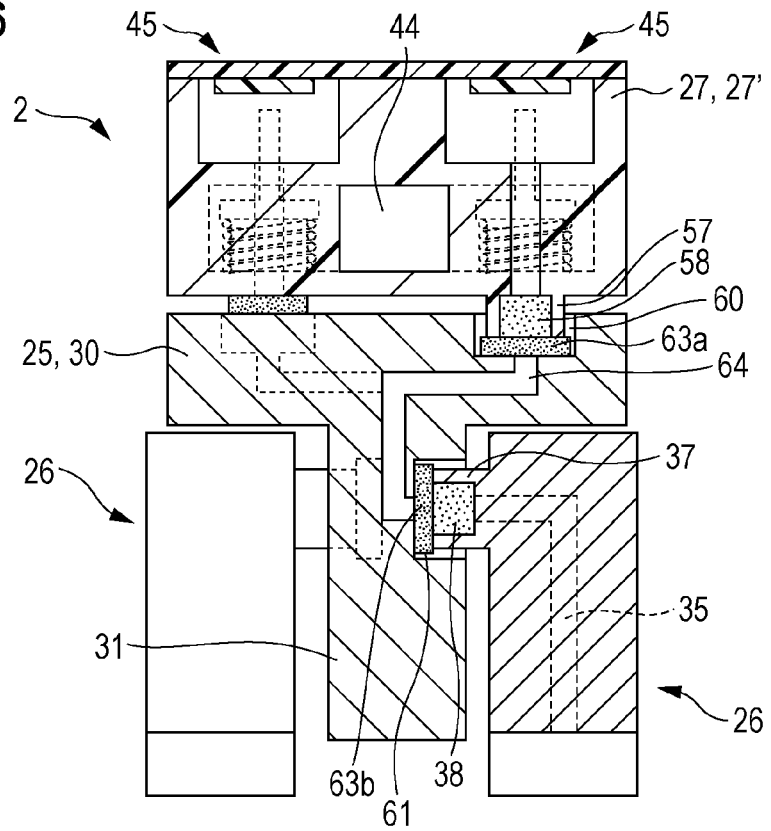
FIG. 6 is a cross-sectional view of a main portion of a head module in a short direction in a second embodiment.

FIG. 6 is a cross-sectional view of the frame 25 of the head module 2 in the short direction (the thickness direction of the fixing frame 31) describing a second embodiment of the invention. In the first embodiment described above, the configuration is exemplified in which the outlet-side connection section 61 on the side of the frame 25 is provided on the lower surface of the base frame 30 and the inlet section 37 on the side of the unit head 26 is provided in the position facing the outlet-side connection section 61 that is provided on the lower surface of the base frame 30, in a state of being fixed to the frame 25 in the upper surface on the side opposite the nozzle surface, that is, the configuration is exemplified in which the ink is introduced into the unit head 26 in the vertical direction, but the invention is not limited to the embodiment. In the embodiment, as illustrated in FIG. 6, the outlet-side connection section 61 on the side of the frame 25 is provided by corresponding to the mounting position of each unit head 26 in the head mounting surface of the fixing frame 31. Therefore, the communication flow path 64 communicating between the inlet-side connection section 60 on the side of the upper surface of the base frame 30 and the outlet-side connection section 61 on the side of the fixing frame 31 is bent into a crank shape according to the shape of the frame 25 inside the frame 25, and is formed from the base frame 30 across the fixing frame 31. Further, the inlet section 37 on the side of the unit head 26 is provided in the position facing the outlet-side connection section 61 on the side of the fixing frame 31 in the side surface of the mounting side of the head case 33 with respect to the fixing frame 31. In the configuration, the ink is introduced from the side surface (from the horizontal direction) of the unit head 26. Moreover, the other configurations are the same as those of the first embodiment. Since the inlet section 37, which is provided in the upper surface in the unit head 26 in the first embodiment, is provided in the side surface of the head case 33 in the second embodiment, it is possible to reduce the height of the unit head 26, accordingly. Therefore, it is possible to fix the unit head 26 closer to the side of the base frame 30. As a result, it is possible to contribute to the reduction in the height of the whole head module.

Moreover, for the frame 25, in each embodiment described above, the configuration is exemplified in which the base frame 30 and the fixing frame 31 are combined, but the invention is not limited to the embodiment, and it is also possible to employ a configuration of only the base frame 30 without the fixing frame 31. In this case, the unit head 26 is fixed to the lower surface (a first surface) of the base frame 30 and, as described in the first embodiment, it is configured to perform the supplying and receiving of the ink to the unit head 26 in the vertical direction.

Further, the invention is not limited to each embodiment described above. Further, in the embodiments described above, the head module 2 equipped in the ink jet printer is exemplified, but it is also possible to apply the head module 2 to an apparatus that ejects a liquid other than the ink if the apparatus employs the head module having the configuration described above. For example, it is possible to apply the invention to a color material ejecting head for using in manufacturing a color filter of a liquid crystal display or the like, an electrode material ejecting head for using in forming electrode of an organic electro luminescence (EL) display, a field emission display (FED) or the like, a bio-organic substance ejecting head for using in manufacturing a biochip (a biochemistry element), or the like.

What is claimed is:

1. A liquid ejecting head module comprising:

a unit head that introduces a liquid into a liquid flow path formed inside thereof and ejects the liquid from nozzles which are open on a nozzle surface;

a fixing member to which a plurality of unit heads are fixed; and a common flow path unit that has a common flow path, which distributes the liquid to each unit head fixed to the fixing member by receiving the liquid from a liquid supply source, along an arrangement direction of the unit heads in series, and is attached to a mounting surface of the fixing member that is positioned on the side opposite the nozzle surface of the unit head that is fixed, wherein the unit head has an inlet section that introduces the liquid from a side of the common flow path unit into the liquid flow path through a first porous member, wherein the common flow path unit has a pressure control section that controls a pressure of the liquid supplied from the common flow path to the unit head corresponding to each unit head, individually, and has an outlet section that delivers the liquid from the pressure control section through a second porous member, wherein the pressure control section has a valve that switches supply or non-supply of the liquid and a flexible member that opens and closes the valve by being displaced in response to a pressure change inside the pressure control section, wherein the flexible member is provided in a surface on the side opposite a side of the fixing member in the common flow path unit, wherein the fixing member has an inlet-side connection section to which the outlet section of the common flow path unit is connected, an outlet-side connection section to which the inlet section of the unit head is connected, and a communication flow path that communicates with the inlet-side connection section and the outlet-side connection section, wherein the inlet-side connection section includes a third porous member where the second porous member of the outlet section abuts, wherein the outlet-side connection section includes a fourth porous member where the first porous member of the inlet section abuts, and wherein supplying and receiving of the liquid are performed by surface contact between the second porous member and the third porous member and by surface contact between the first porous member and the fourth porous member.

2. The liquid ejecting head module according to claim 1, wherein a filter that filters the liquid inside the flow path is provided in the middle of the flow path connecting between the liquid supply source and the common flow path unit.

3. The liquid ejecting head module according to claim 1, wherein the fixing member has a first fixing member that has a mounting surface to which the common flow path unit is attached and a second fixing member that protrudes from a surface on the side opposite the mounting surface of the first fixing member, and has a fixing surface that is vertical to the surface, and wherein the unit heads are respectively fixed to the fixing surfaces on both sides of the second fixing member so as to be alternate with each other in the arrangement direction of the unit heads.

4. The liquid ejecting head module according to claim 1, wherein the unit head has the inlet section on the surface on the side opposite the nozzle surface, and wherein the outlet-side connection section is disposed in a position facing the inlet section of the surface of the fixing member facing each unit head.

5. The liquid ejecting head module according to claim 3, wherein the outlet-side connection section is provided on the side of the fixing surface of the second fixing member, and wherein the unit head has the inlet section in a position facing the outlet-side connection section on the surface of a mounting side with respect to the fixing surface.

6. A liquid ejecting apparatus comprising:

the liquid ejecting head module according to claim 1.

7. A liquid ejecting apparatus comprising:

the liquid ejecting head module according to claim 2.

8. A liquid ejecting apparatus comprising:

the liquid ejecting head module according to claim 3.

9. A liquid ejecting apparatus comprising:

the liquid ejecting head module according to claim 4.

10. A liquid ejecting apparatus comprising:

the liquid ejecting head module according to claim 5.

* * * * *